US012129680B1

(12) United States Patent
Korfel

(10) Patent No.: US 12,129,680 B1
(45) Date of Patent: Oct. 29, 2024

(54) ANGLE BRACE ASSEMBLY AND A METHOD OF PROVIDING SUPPORT WITH AN ANGLE BRACE

(71) Applicant: Douglas Korfel, Chester, SC (US)

(72) Inventor: Douglas Korfel, Chester, SC (US)

( * ) Notice: Subject to any disclaimer, the term of this patent is extended or adjusted under 35 U.S.C. 154(b) by 0 days.

(21) Appl. No.: 18/150,108

(22) Filed: Jan. 4, 2023

(51) Int. Cl.
*E04H 17/02* (2006.01)
*E04H 12/20* (2006.01)
*E04H 17/20* (2006.01)

(52) U.S. Cl.
CPC ..... *E04H 17/23* (2021.01); *E04H 12/20* (2013.01)

(58) Field of Classification Search
CPC ..... E04H 17/23; E04H 12/20
See application file for complete search history.

(56) References Cited

U.S. PATENT DOCUMENTS 1,725,475 A * 8/1925 Peterson ..... E04H 17/23 52/150
3,507,121 A * 4/1970 Oskar ..... E02D 5/76 52/741.11
3,745,774 A * 7/1973 Sharp, Jr. ..... E21B 7/12 114/295
4,479,636 A * 10/1984 King ..... E04H 17/08 256/22
4,705,262 A * 11/1987 Roberts ..... E04H 17/26 256/37
4,763,879 A * 8/1988 Wasicek ..... E04H 17/08 256/70
5,104,074 A * 4/1992 Malloy ..... E04H 12/2215 52/156
5,791,635 A * 8/1998 Hull ..... E04H 12/223 52/156
2015/0108318 A1* 4/2015 Orr ..... E04H 12/2284 248/523
2019/0301152 A1* 10/2019 Hansort ..... E04C 5/16
2023/0175287 A1* 6/2023 Centoni ..... E04H 17/1413 256/35

* cited by examiner

*Primary Examiner* — Amy J. Sterling
(74) *Attorney, Agent, or Firm* — Hanrahan Law Firm, P.A.; Benjamin M. Hanrahan

(57) ABSTRACT

An angle brace assembly and a method for supporting an upright structure with an angle brace assembly is presented herein. The angle brace assembly includes a ground anchor assembly vertically mounted into the ground with a top exposed end extending above the ground. An elongated angle brace with a first connector at a first end and a second connector at a second end is angularly mounted to and between the upright structure and the ground anchor assembly with the second end and said second connector being disposed at a lower height from the ground relative to the first end and the first connector.

6 Claims, 10 Drawing Sheets

ANGLE BRACE ASSEMBLY AND A METHOD OF PROVIDING SUPPORT WITH AN ANGLE BRACE

FIELD OF THE INVENTION

The present invention is generally directed to an angled support assembly, and more specifically to an angle brace assembly and a method of providing support using an angle brace assembly.

BACKGROUND OF THE INVENTION

Fences, barriers, railings or other like structures are commonly installed in residential, commercial and public areas to enclose an area, mark a boundary, control access, or prevent escape, among other reasons. Although fences can be made from several different materials (e.g., metal, aluminum, steel, plastic, wood, etc.) and can have different styles, looks and textures, nearly all fences have one, or more likely, several vertical posts, beams or stanchions. The vertical posts, beams or stanchions may, in some cases, be at least partially driven into a hole in the ground, which may, in some cases, be filled with concrete or other like substance.

In many cases, the operation of the fence is highly dependent on the stability of the posts in that if one or more of the posts lean, tilt, sag or fall over, the integrity of the entire fence may be compromised. As the fence ages, or as the ground softens or shifts over time, fence posts can be susceptible to failure, leaning, collapse, etc. For this, and other reasons, some fence posts may need or may benefit from additional support in order to maintain its upright or vertical position as desired and as needed for the proper operation of the fence. The additional support often comes as an angled brace which is a support beam that provides an angled force to the fence post.

However, in many cases, since the additional support beam is angled, it can be difficult to drive the angled beam, or a ground sleeve, into the ground at the same angle as the support beam. In other words, driving a support beam or ground sleeve into the ground at an angle other than vertical or substantially vertical can be difficult, time consuming and laborious.

There is, thus, a need in the art for an angled brace assembly which includes a ground anchor assembly that can be driven vertically into the ground in an upright or substantially upright orientation, a task that is much easier than and angled installation. Then, an angled post can be secured to the vertically-oriented ground anchor assembly and angled toward the fence post for additional support thereof.

It would also be beneficial if the proposed angle brace assembly is capable of being used in other applications, i.e., to support other structures in addition to or instead of fence posts, such as, but in no way limited to, sports stanchions (e.g., basketball hoop stanchions, tennis net posts, volleyball net posts, etc.), tree trunks, bushes or other plants, walls, barriers, etc.

SUMMARY OF THE INVENTION

Accordingly, the present invention is generally directed to an angle brace assembly and a method of supporting a vertical or upright post or structure with an angle brace assembly. In particular, the proposed angle brace assembly of at least one embodiment of the present invention includes a ground anchor assembly that is, in most cases, vertically mounted or driven into the ground in a substantially up-and-down orientation perpendicular to the surface of the ground. When installed, or otherwise after being driven into the ground, the ground anchor assembly May maintain or include a top exposed end that extends above the ground or is otherwise accessible.

In some embodiments, the ground anchor assembly includes at least two components-a ground sleeve and an anchor post. The ground sleeve is driven into the ground first and includes an open top end from which an internal channel extends. The anchor post is then disposed or positioned within the installed ground sleeve and which defines the top exposed end of the ground anchor assembly. In some cases, the anchor post can be attached to the ground sleeve, for example, with a set screw, a fastener, etc.

With the ground anchor assembly (e.g., the ground sleeve and the anchor post) installed, an elongated angle brace is then connected to and between the ground anchor assembly and the supported structure (e.g., the fence post). In some embodiments, a first connector may be attached or a first end of the angle brace and a second connector may be attached or mounted to a second, opposite end of the anchor brace. The two connectors may then attach to the supported post and the ground anchor assembly, respectively, in order to secure the angle brace therebetween.

In this manner, the ground sleeve may be driven straight down into the ground, e.g., along a vertical or near-vertical axis, without having to drive the ground sleeve into the ground at the same angle as the angle brace. This ensures an easy installation, resulting in less labor and additional support for the supported post.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
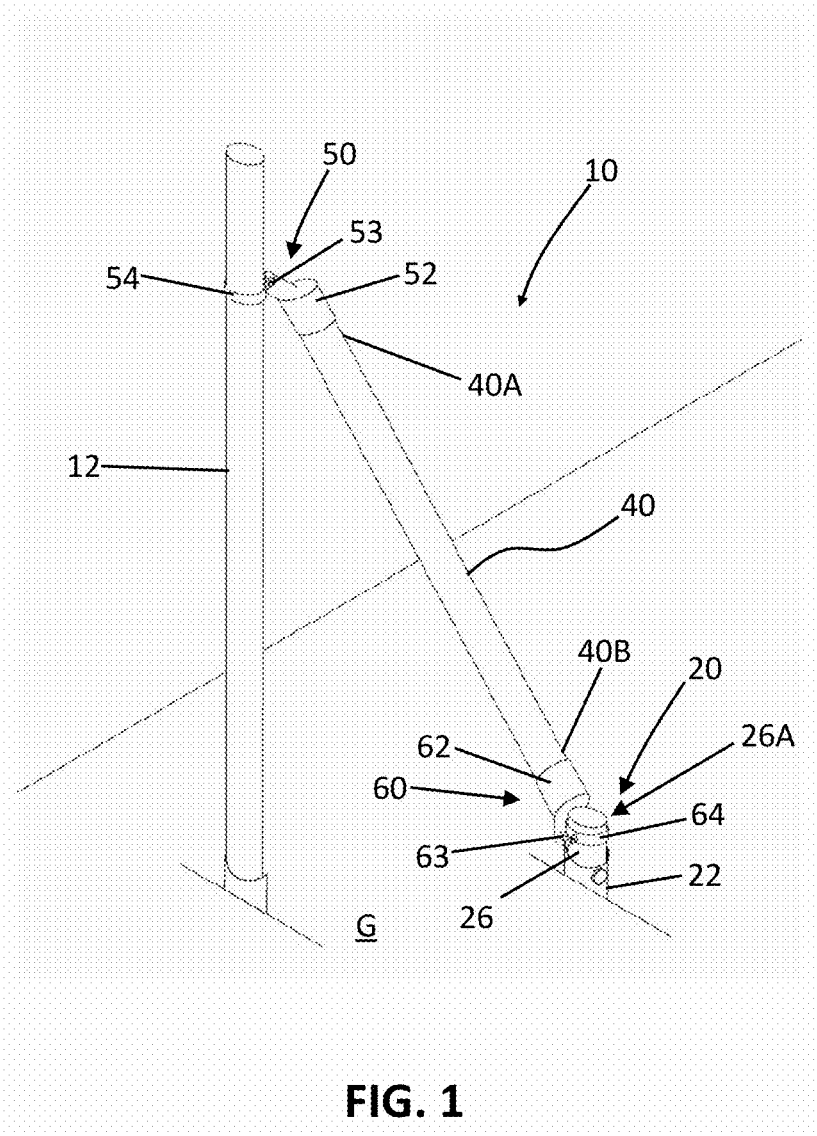
FIG. 1 is a perspective view of the angle brace assembly installed and supporting a post, as disclosed in accordance with at least one embodiment of the present invention.
Figure 3:
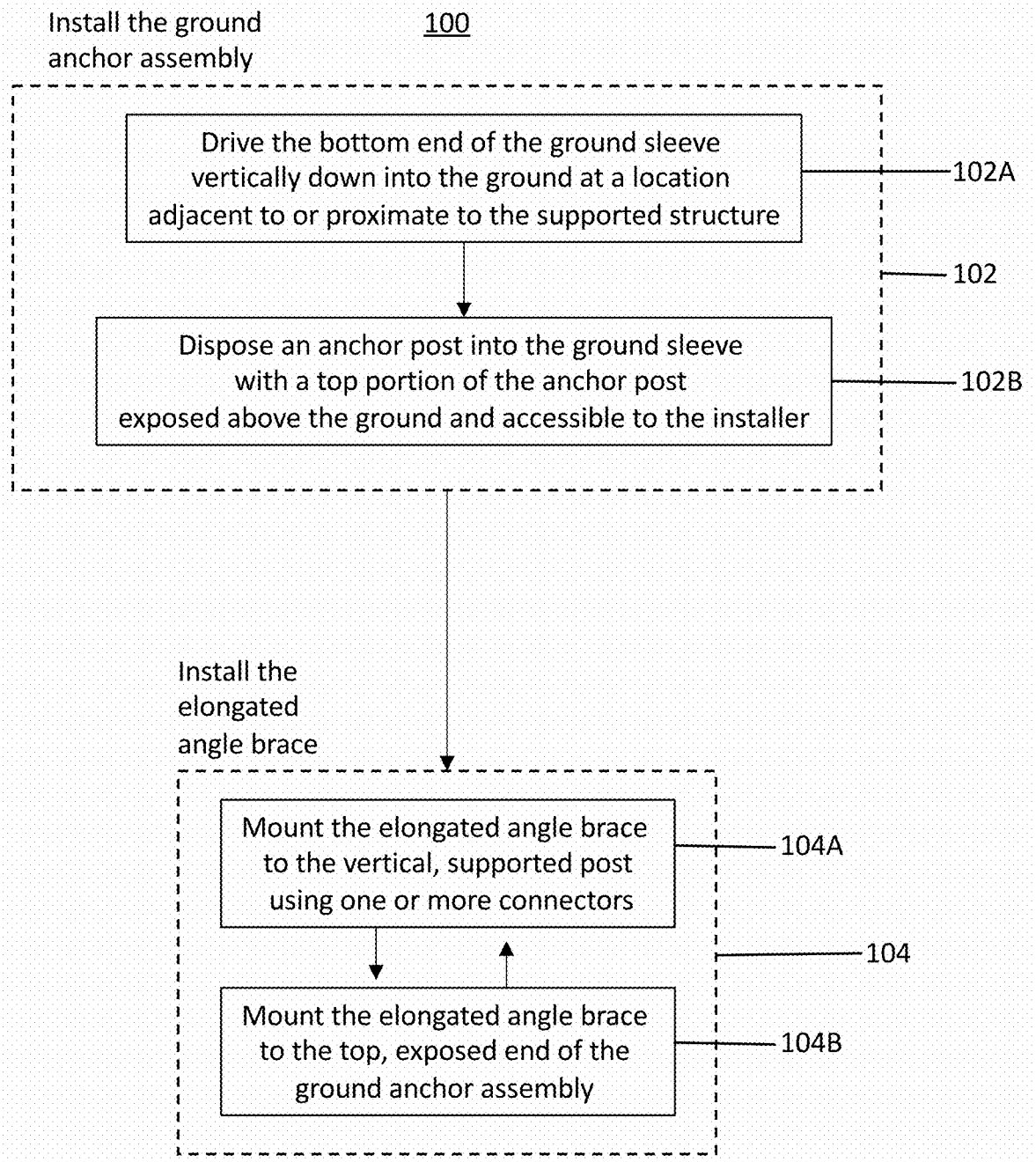
FIG. 3 is a high level flow chart illustrating the method of supporting a vertical post with an angled brace assembly, as disclosed in accordance with at least one embodiment of the present invention.

As shown in the accompanying drawings, and with particular reference to FIGS. 1 and 3, the present invention is generally directed to an angle brace assembly 10 and a method 100 of providing support to a vertical or other structure 12. More specifically, in many cases or applications of the present invention, the vertical or supported structure 12, as used herein, is a post, beam, pole, shaft, stanchion, etc. that is mounted into the ground G and extends in a generally or substantially vertical or upright orientation. In this manner, the vertical or other supported structure 12 may be a fence post, or a post used in the construction of a fence such as a metal, aluminum, steel, chain-linked, wood, or other fence. However, it should be noted that the supported structure 12 or post described herein can be virtually any structure or post which May need or may benefit from an angled support, such as a sports post (e.g., basketball stanchion, volleyball net posts, tennis net posts, etc.), a wall, barrier, tree, etc.

In any case, as described herein, the angle brace assembly 10 is configured to mount, e.g., removably or fixedly, to the vertical post or structure 12, and angle down toward the ground G where the angle brace assembly 10 is mounted, installed or driven into the ground G or other surface. The term ground G is used herein to describe the surface upon which the vertical post or supported structure 12 and the angle brace assembly 10 is/are mounted, which in many cases, is the solid outside surface of the earth, particularly when the vertical post or structure 12 is a fence post. However, it should be noted that the ground G can be virtually any supporting surface, whether natural or man-made, such as, asphalt, artificial turf or artificial surface, concrete, wood, etc.

More in particular, and with reference to FIG. 1, the angle brace assembly 10 of at least one embodiment of the present invention includes a ground anchor assembly 20 and an elongated angle brace 40. As shown, the ground anchor assembly 20 is mounted or driven into the ground G adjacent to or proximate to the supported post or structure 12 with the elongated angle brace 40 mounted there between. For instance, in at least one embodiment, the ground anchor assembly 20 is vertically driven into the ground G, which may be in a generally parallel orientation relative to the supported structure 12. This is more advantageous and easier to install than angularly driving a post into the ground.

Furthermore, as described herein in accordance with at least one embodiment, the ground anchor assembly 20, when properly installed into the ground G, includes or has a top, exposed end 21 that in many cases extends above the ground G or is otherwise accessible by the installer. As just an example, the ground anchor assembly 21 may be installed with at least two (2) inches of the top end 21 exposed, however, other embodiments or installations may define a longer or shorter exposed end 21. As described herein, the angle brace 40 will attach to the top exposed end 21 of the ground anchor assembly 20 via one or more corresponding connectors.

Moreover, it should also be noted that in some embodiments, the ground anchor assembly may be constructed of or include a single, unitary piece, such as a single post or shaft driven into the ground with a top, exposed end available for connection with the angle brace 40. In other embodiments, for example, as illustrated in FIGS. 1 and 2A-2E, the ground anchor assembly 20 may include at least two components-a ground sleeve 22 and an anchor post 26.

In such an embodiment, the ground sleeve 22 may include an elongated and straight configuration defining an open top end 22*a* and an oppositely disposed bottom end 22B. A channel or at least partially hollow interior portion 23 may extend from the open top end 22A through at least a portion of the ground sleeve 22. In some cases, the bottom end 22B of the ground sleeve may define a point a crimped end, or an at least partially closed end. The point or bottom end 22B of the ground sleeve can be easily driven into the ground G using any method. As just an example, a post hole may be dug or excavated (e.g., using a shovel, post hole digger, clamshell digger, manual or power drill or auger, etc.) within which the ground sleeve 22 may be disposed, or if desired or able, the ground sleeve 22 may be driven into the ground G with force and without first digging a hole.

Figure 2A:
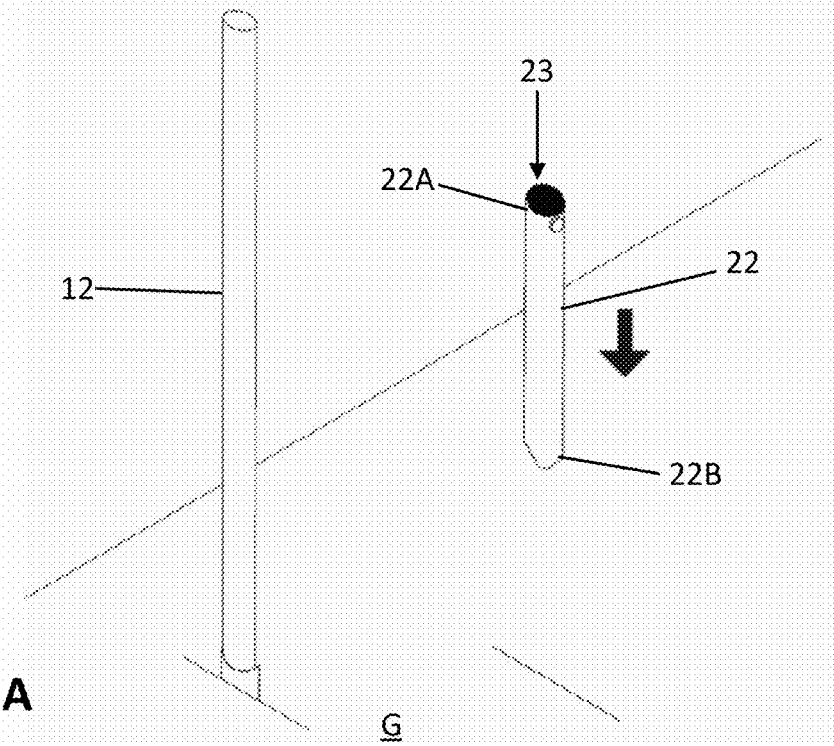
FIG. 2A is an exploded view illustrating the ground sleeve being installed vertically down into the ground, as disclosed in accordance with at least one embodiment of the present invention.
Figure 2B:
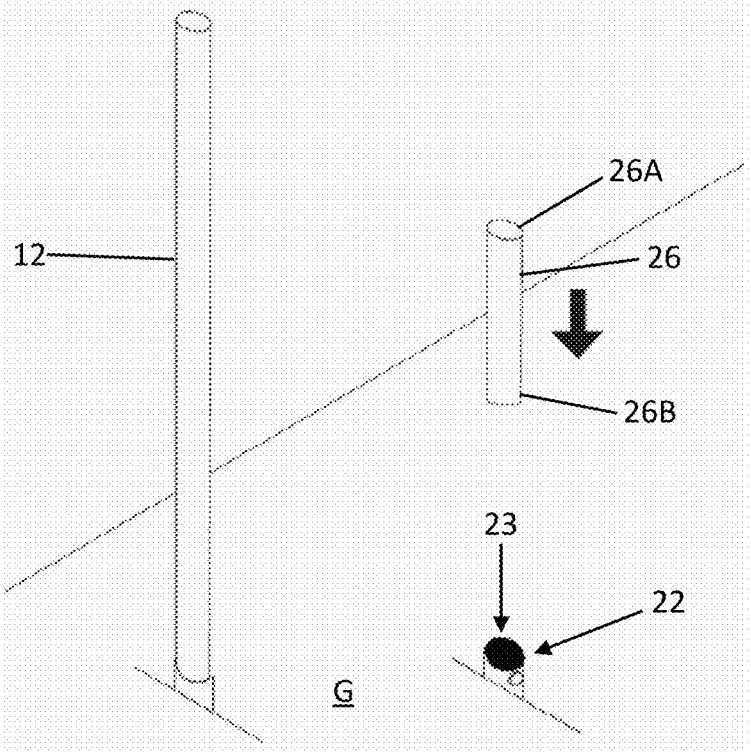
FIG. 2B is an exploded view illustrating the anchor post being disposed within the ground sleeve, as disclosed in accordance with at least one embodiment of the present invention.
Figure 2C:
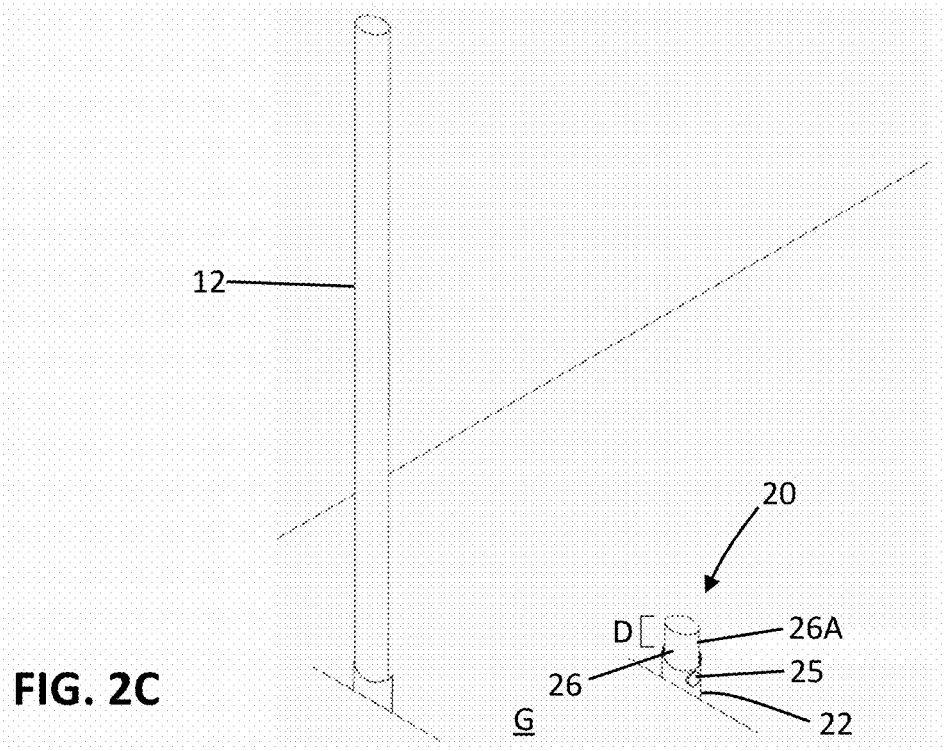
FIG. 2C is an exploded view illustrating the anchor post installed within the ground sleeve, with a top portion thereof exposed and extending above the ground, as disclosed in accordance with at least one embodiment of the present invention.

Referring now to FIGS. 2B-2C, the anchor post 26 may be disposed at least partially down into the ground sleeve 22. For example, the anchor post 26 of at least one embodiment includes an elongated and straight configuration defining a first or top end 26A and a second or bottom end 26B. In some cases, the anchor post 26 is constructed out of a hollow metal post, although other materials, shapes and sizes are contemplated within the full spirit and scope of the present invention. More in particular, and still referring to FIGS. 2B and 2C, the second or bottom end 26B of the anchor post 26 is disposed or otherwise positioned into the interior channel 23 of the ground sleeve 22 through the top open end 22A thereof.

In some installations, the installer should leave a portion of the top end 26A of the anchor post 26 extending above the ground G or extending beyond the top end 22A of the ground sleeve 22, as generally shown in FIG. 2C. For example, the top end 26A of the anchor post may extend beyond the ground G or ground sleeve 22 a distance D. In some cases, distance D may be approximately two (2) inches, however, other distances D larger or smaller than two (2) inches is contemplated within the full spirit and scope of the present invention. In any case, the exposed portion or end 26A of the anchor sleeve 26 becomes the top exposed end of the ground anchor assembly described above to which the angle brace 40 may be mounted.

It should also be noted that in some embodiments, the anchor post 26 may be mounted to or secured to the ground sleeve 22 through one or more fasteners 25, such as one or more bolts, screws, pins, grooves, clips, clamps, etc. In some cases, the ground sleeve 22 and/or the anchor post 26 may include one or more cooperative grooves, ledges, edges, clips, etc. (not shown) that cooperate with one another to at least partially mate or secure the anchor post 26 to and within the ground sleeve 22. The fastener(s) 25 and/or other cooperating features may be used to ensure that the anchor post 26 is secured in place and with the desired amount (e.g., distance D) of exposed end 26A extending therefrom.

It should be noted again that in at least one embodiment, the ground anchor assembly 20, and in particular, the ground sleeve 22 and the anchor post 26 thereof, are mounted into the ground G in a vertical, upright orientation or a substantially vertical, upright orientation. More specifically, in use, the ground sleeve 22 and/or anchor post 26 may not be perfectly vertical and therefore, the terms vertical, upright, and substantially vertical or substantially upright should be interpreted to accommodate slight variations in the installation thereof.

Figure 2D:
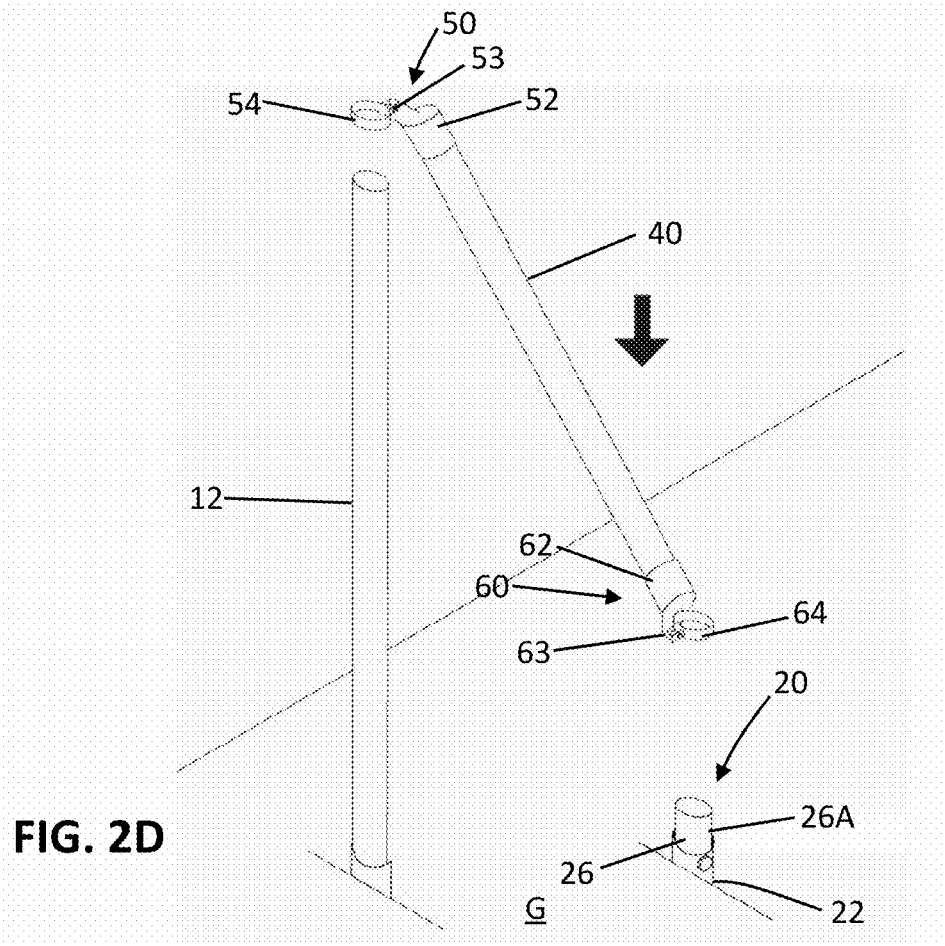
FIG. 2D is an exploded view illustrating the angle brace being installed to and between the vertical post and the ground anchor assembly, as disclosed in accordance with at least one embodiment of the present invention.
Figure 2E:
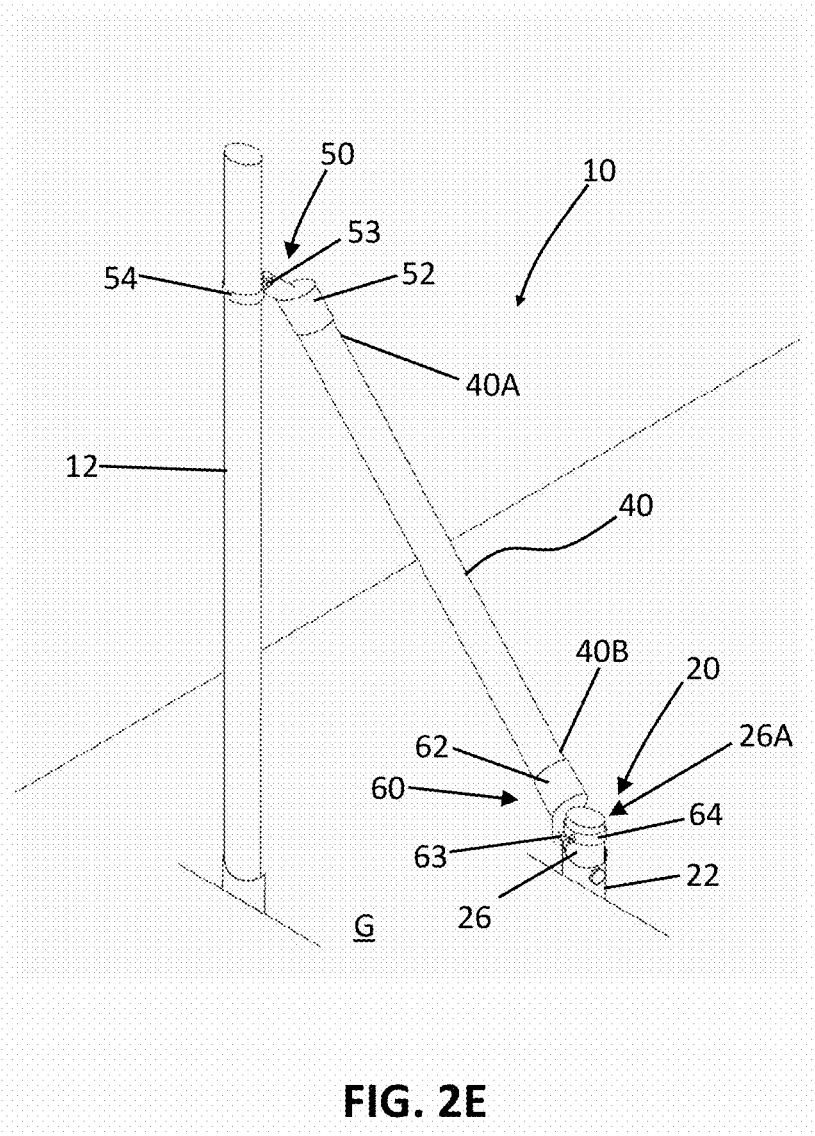
FIG. 2E is another perspective view of the angle brace assembly installed and supporting a vertical post, as disclosed in accordance with at least one embodiment of the present invention.

In this manner, and now referring to FIGS. 2D and 2E, the angle brace 40 may be installed and mounted or secured to and between the ground sleeve assembly 20 and the supported structure 12. In particular, the angle brace 40 of at least one embodiment includes an elongated post that in many cases defines a straight post with opposing first and second ends 40A, 40B respectively. It should be noted that the angle brace 40 or post may in other embodiments include a curved, angled or other configuration and still fall within the spirit and scope of the present invention. In any case, the angle brace 40 or post may be constructed out of any durable or rigid material, such as metal, aluminum, steel, plastic, wood, etc. and is configured to extend between the ground support assembly 20 and the supported structure 12 in order to provide support to the supported structure 12. In other words, the angle brace 40 is intended to provide a supporting force to the structure 12 in order to prevent or restrict against the supported structure from falling or leaning in an undesired orientation.

Specifically, in at least one embodiment, the angle brace 40 is mounted or attached to the supported structure 12 via a first connector 50, and to the ground support assembly 20 via a second connector 60. In at least one embodiment, the first connector 50 is attached or mounted to a first end 40A of the angle brace 40 and secures to the supported structure 12 along a length thereof. More specifically, the first connector 50 of at least one embodiment includes a cap 52 which is disposed on and at least partially surrounds the first end 40A of the anchor post 40. An attachment extension (e.g., in the form of a ring or clamp) 54 is movably and/or pivotally attached to the cap 52 at a hinge or swivel 53. Accordingly, with the cap 52 secured to the end 40A of the anchor post 40, the extension 54 can wrap around or at least partially around the supported structure 12, for example, along a length of the structure 12 and can engage thereto via frictional force, clamping force, and/or one or more fasteners.

Similarly, in at least one embodiment, the angle brace 40 is mounted or attached to the ground support assembly 20 via a second connector 60. More specifically, the second connector of at least one embodiment includes a cap 62 which is disposed on and at least partially surrounds the second end 40B of the anchor post 40. An attachment extension (e.g., in the form of a ring or clamp) 64 is movably and/or pivotally attached to the cap 62 at a hinge or swivel 63. Accordingly, with the cap 62 secured to the end 40B of the anchor post 40, the extension 64 can wrap around or at least partially around the top, exposed surface of the ground support assembly 20, e.g., the top portion 26A of the anchor post 26. The extension 64 can engage to the top portion 26A of the anchor post 26 via frictional force, clamping force, and/or one or more fasteners.

It should also be noted that other connectors, attachments, clamps, pins, fasteners, etc. can be used to secure or attach the angle brace 40 to the supported structure 12 and to the ground support assembly 20. In any case, as shown in FIGS. 1 and 2E, for example, when the angler brace 40 is installed, for example, in the manner described herein, the first end 40A thereof, and therefore the first connector 50, will be disposed at a height (or distance from the ground G) greater than the second end 40B and second connector 60. In other words, the angle brace 40 is disposed in an upwardly directed angle from the ground anchor assembly 20 to the supported structure 12 in order to provide the angled force and support thereto.

With reference now to FIG. 3, the method 100 of providing support to a post or other structure 12 is illustrated. Specifically, the method 100 includes the step of installing the ground anchor assembly, as generally shown at 102. As described herein, the ground anchor assembly 20 of at least one embodiment may include one (e.g., a single anchor post) or more components (e.g., an anchor sleeve and anchor post). And therefore the step of installing he ground anchor assembly may be altered accordingly.

With reference to the embodiment of FIG. 3, the step 102 of at least one embodiment includes driving a ground sleeve 22 vertically down into the ground G, as shown at 102A. In other words, the ground sleeve 22 of at least one embodiment is driven straight down into the ground G with a driving axis that is generally perpendicular to the surface of the ground G. In many cases, the use of concrete or other like substance is not needed. Rather, the ground sleeve 22 can be driven directly into the ground and supported by the substance of the ground or earth.

Next, as shown at 102B, an anchor post 26 is disposed or positioned down into the ground sleeve, for example, into a hollow interior channel of the ground sleeve 22 through an open top end 22A thereof. In some cases, the anchor post 26 may be fastened to the ground sleeve 22 with one or more fasteners to secure or fix its relative position. As described herein, in at least one embodiment, the anchor post 26 is secured with a portion of its top end 26A (for example, but not limited to, approximately two inches) extending above the ground G, extending above the ground sleeve 22, or otherwise accessible to the installer.

With the ground anchor assembly 20 installed, and with the supported post or structure 12 in place, the angle brace 40 can then be installed and mounted to and between the supported structure 12 and the ground anchor assembly 20, as shown at 104.

For example, as shown at 104A, the elongated angle brace 40 may be mounted to the supported structure 12 via one or more connectors 50 or attachment structures. In the example shown, the connector 50 may include a cap 52, with a movable or pivoting ring 54 extending therefrom, although as provided above, other connectors may be used within the scope of the present invention to the supported structure 12.

Furthermore, as shown at 104B, the elongated angle brace 40 may be mounted to the ground anchor assembly 20 via one or more connectors 60 or other attachment structures. In the example shown, the connector 60 may include a cap 62, with a movable or pivoting ring 64 extending therefrom, although as provided above, other connectors may be used within the scope of the present invention to connect or attach the angle brace 40 to the ground anchor assembly 20.

It should be noted that the order of several steps provided in the method, for example, steps 104A and 104B, may be interchanged without diverting from the full sprit of the present invention. For example, the angled post or bracket can be mounted first to either the vertical post 12 or the ground anchor assembly 20, and then mounted to the other one.

Figure 4:
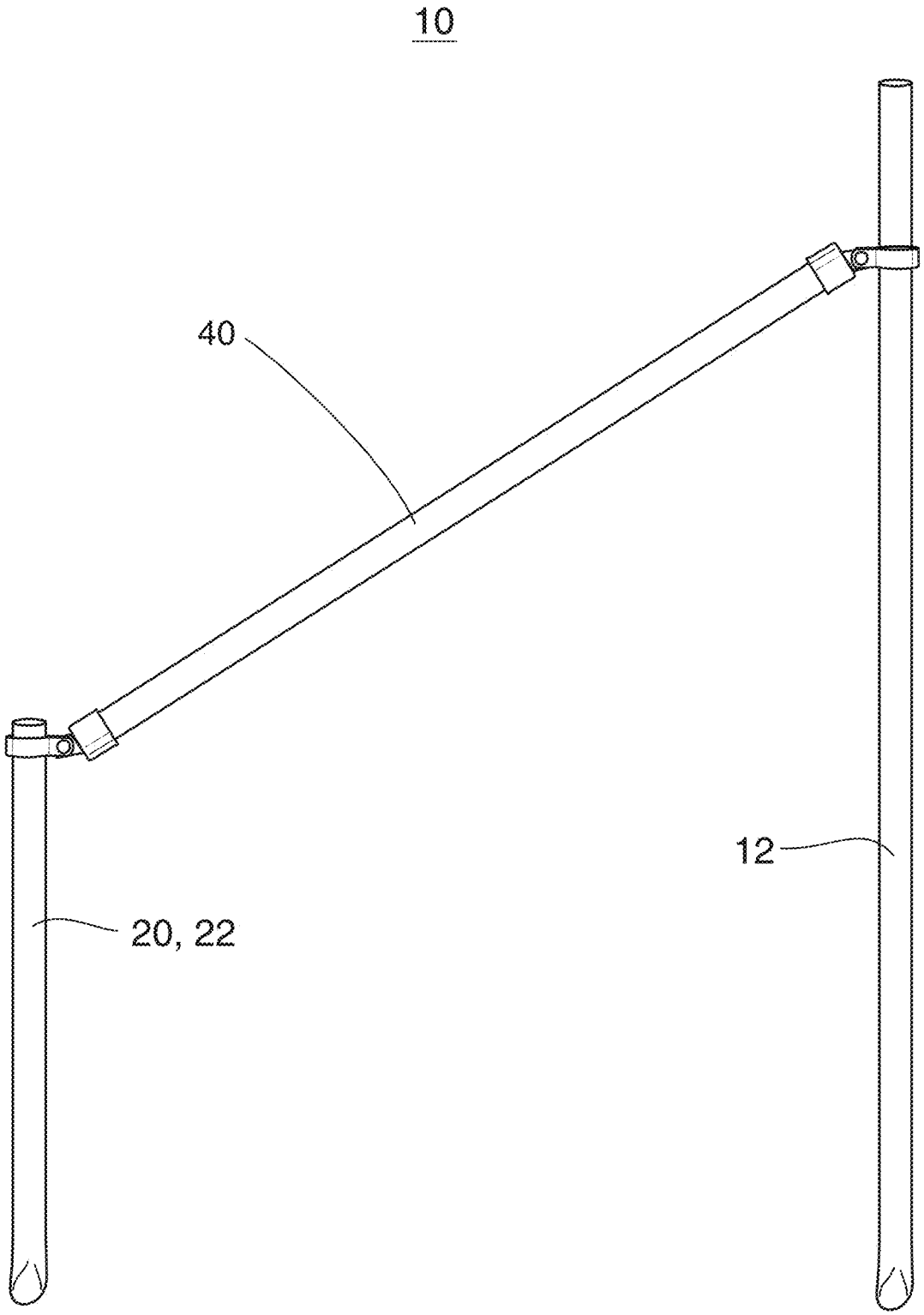
FIG. 4 illustrates the ground anchor assembly, angle brace and supported post, as disclosed in accordance with at least one embodiment of the present invention.
Figure 5:
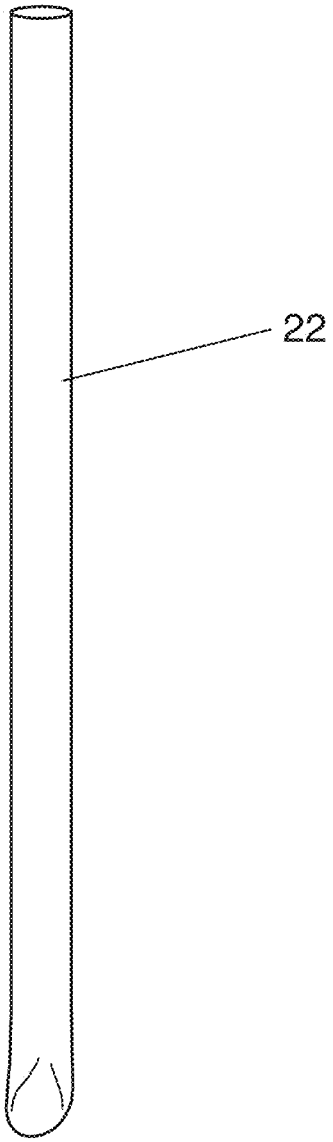
FIG. 5 illustrates an exemplary ground sleeve of at least one embodiment of the present invention.
Figure 6:
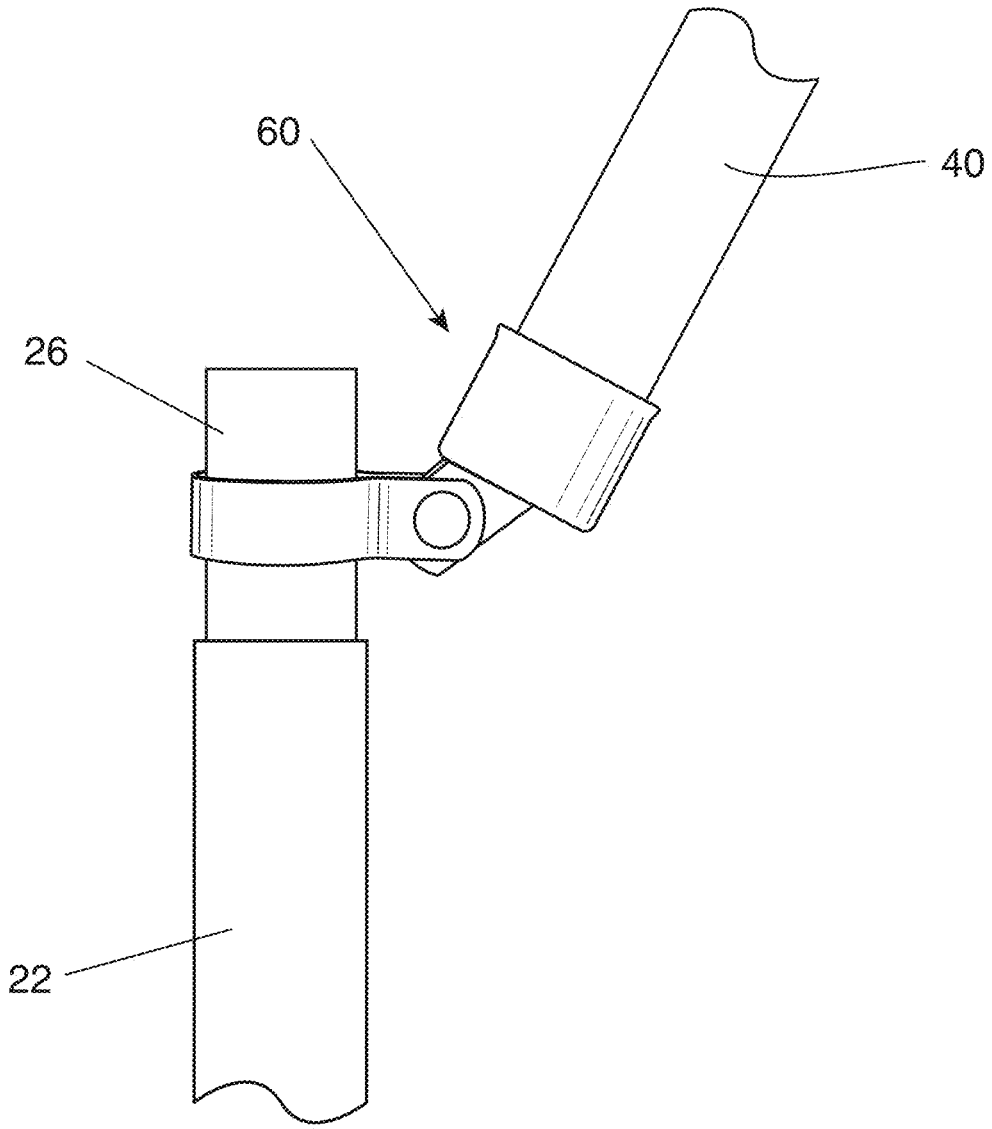
FIG. 6 is a partial view of a connection between the ground anchor assembly and the angle brace of at least one embodiment of the present invention.
Figure 7:
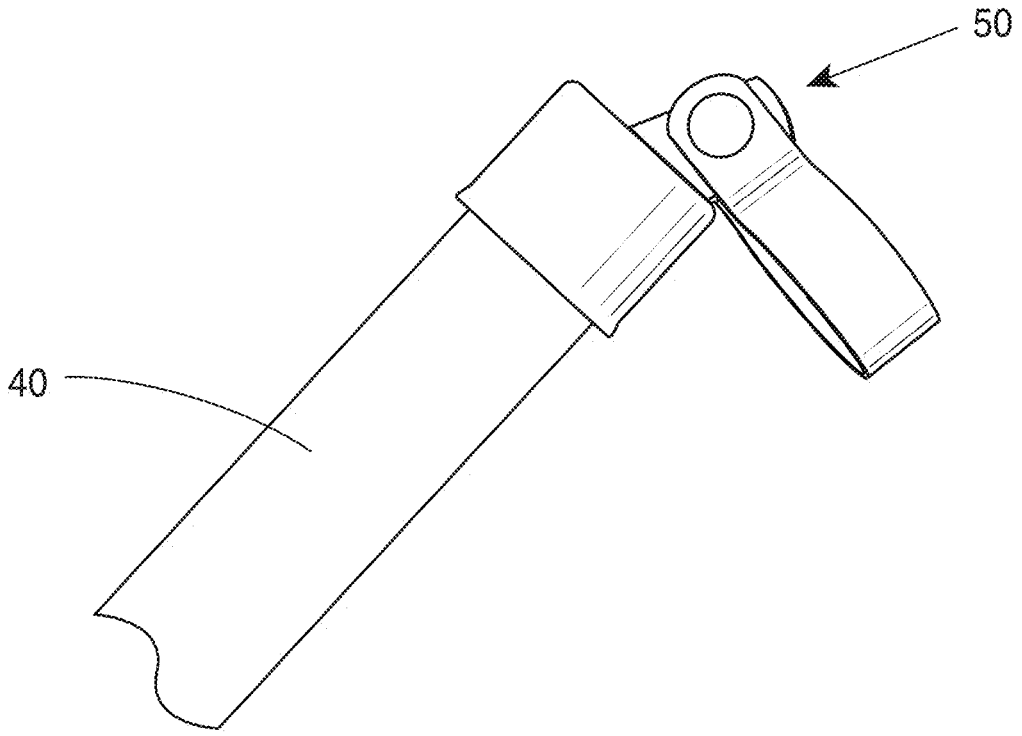
FIG. 7 illustrates the top end of the angle brace with a connector extending therefrom, as disclosed in accordance with at least one embodiment of the present invention.
Figure 8:
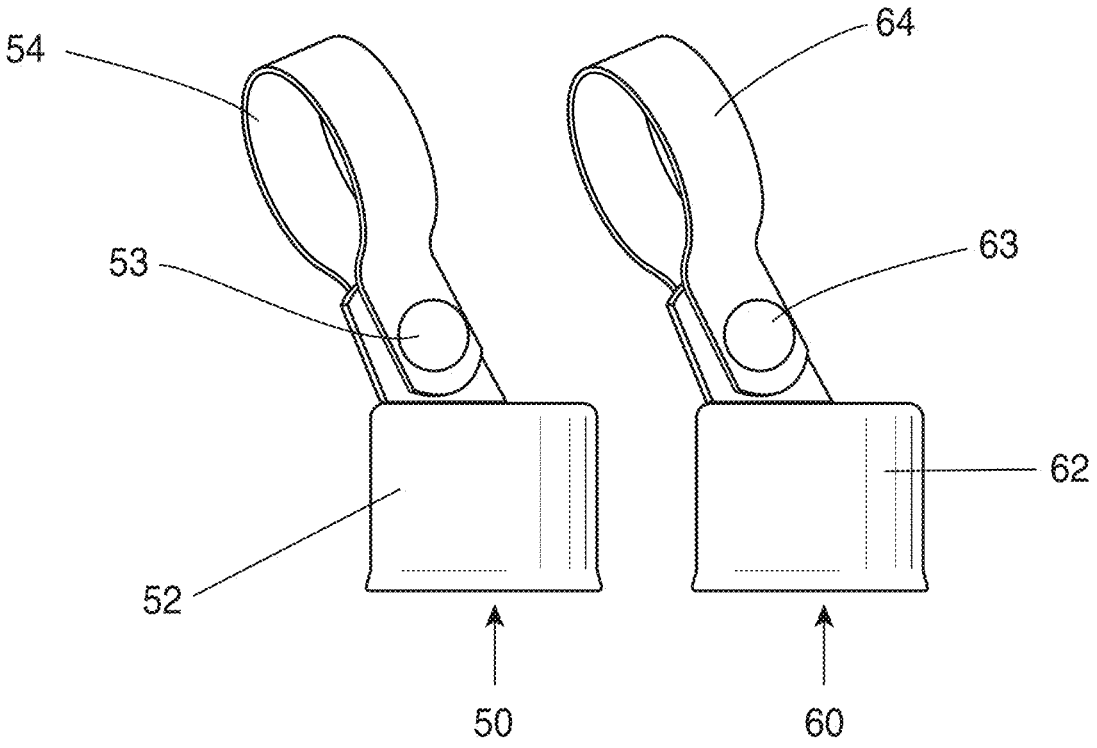
FIG. 8 is a side perspective view of the connectors, as disclosed in accordance with at least one embodiment of the present invention.

Moreover, FIGS. 4-8 are provided as additional views of the angle brace assembly 10 of at least one embodiment of the present invention and components thereof. In particular, FIG. 4 shows another embodiment of the present invention illustrating the ground anchor assembly 20, angle brace 40 and supported post 12. FIG. 5 shows an exemplary ground sleeve 22 of at least one embodiment of the present invention. FIG. 6 shows a partial view of the connection between the ground anchor assembly 20 of at least one embodiment and the angle brace 40. FIG. 7 illustrates the top or first end 40A of the angle brace 40 of at least one embodiment with connector 50 extending therefrom. FIG. 8 shows exemplary connectors 50, 60 as described herein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. An angle brace assembly for supporting a vertical post, said assembly comprising:

a ground anchor assembly vertically mounted into the ground with a top exposed end extending above the ground, wherein said ground anchor assembly comprises a ground sleeve and an anchor post a least substantially vertically mounted into the ground, wherein said ground sleeve comprises an elongated post defining a bottom end and an open top end, said ground sleeve further defining an at least partially hollow interior channel extending from said open top end, wherein said bottom end of said ground sleeve is driven at least partially into the ground, wherein said anchor post comprises an elongated post defining a first end and a second end, wherein said second end of said anchor post is disposed into said hollow interior channel of said ground sleeve through said open top end, wherein a portion of said top end of said anchor post extends above said open top end of said ground sleeve and defines said top exposed end of said ground anchor assembly extending above the ground, an elongated angle brace comprising a first connector at a first end and a second connector at a second end, said first end being longitudinally opposite said second end, wherein said first connector is removably mounted to the vertical post, wherein said second connector comprises an attachment ring attached to said top exposed end of said ground anchor assembly, and wherein, when said elongated angle brace is connected to said ground anchor assembly and providing support to the vertical post, said second connector is disposed at a lower height from the ground relative to said first connector.

2. The angle brace assembly as recited in claim 1 wherein said anchor post is secured to said ground sleeve with at least one fastener.

3. The angle brace assembly as recited in claim 1 wherein said first connector of said angle brace comprises an attachment ring attached along a length of the vertical post at a height above said first connector.

4. A method of providing support to a vertical structure, the method comprising:

installing a ground anchor assembly into the ground proximate to the vertical structure, the ground anchor assembly comprising a top exposed end extending above the ground, the ground anchor assembly comprising a ground sleeve and an anchor post at least substantially vertically mounted into the ground, the ground sleeve comprising an elongated post with a bottom end, an open top end, and an at least partially hollow interior channel extending from the open top end, wherein, installing the ground anchor assembly into the ground comprises driving the bottom end of the ground sleeve vertically down into the ground, wherein, installing the ground anchor assembly into the ground further comprises disposing a second end of the anchor post into the hollow interior channel of the ground sleeve through the open top end, wherein a portion of a top end of the anchor post extends above the open top end of the ground sleeve, the portion of the top end of the anchor post defines the top exposed end of the ground anchor assembly extending above the ground, mounting the elongated brace to the vertical structure via a first connector disposed on a first end of the elongated brace, mounting the elongated brace to the top exposed end of the ground anchor assembly via a second connector disposed on a second end of the elongated brace, the second connector comprising an attachment ring that is attached to the top exposed end of the ground anchor assembly, the first end of the elongated brace being longitudinally opposite the second end of the elongated brace, the first connector being disposed at a height above the second connector when the elongated brace is mounted to the vertical structure and the ground anchor assembly.

5. The method as recited in claim 4 further comprising securing the anchor post to the ground sleeve via at least one fastener.

6. The method as recited in claim 4 further comprising defining the first connector of the elongated brace as comprising an attachment ring that is attached along a length of the vertical structure at a height above said first connector.

* * * * *